United States Patent [19]

Logan

[11] 4,324,425

[45] Apr. 13, 1982

[54] POINT-OF-EGRESS CONTROL DEVICE FOR SECURING EXIT DOORS SAFELY

[76] Inventor: Emanuel L. Logan, 9406 Flower Ave., Silver Spring, Md. 20901

[21] Appl. No.: 929,968

[22] Filed: Aug. 1, 1978

Related U.S. Application Data

[63] Continuation-in-part of Ser. No. 877,893, Feb. 15, 1978, abandoned.

[51] Int. Cl.[3] ..... E05C 15/02

[52] U.S. Cl. ..... 292/201; 292/DIG. 65; 292/92

[58] Field of Search ..... 292/78, 79, 92, 93, 292/192, 201, 209, DIG. 65; 340/542; 70/267, 268, 270

[56] References Cited

U.S. PATENT DOCUMENTS

| | | | |
|---|---|---|---|
| 184,297 | 11/1876 | Potter | 70/267 |
| 1,989,419 | 1/1935 | Hill | 70/26 |
| 2,588,010 | 3/1952 | Kennon | 16/55 |
| 2,733,918 | 2/1956 | Fischer | 292/144 X |
| 2,851,296 | 9/1958 | Guyaz | 292/78 |
| 2,881,020 | 4/1959 | Kok | 292/78 |
| 3,309,125 | 3/1967 | Neveling | 292/78 |
| 3,383,130 | 5/1968 | DeAvila | 292/92 |
| 3,390,909 | 7/1968 | Nagel | 292/DIG. 66 |
| 3,435,643 | 4/1969 | Pollak et al. | 292/216 |
| 3,583,740 | 6/1971 | Armstrong | 292/198 |
| 3,677,043 | 7/1972 | Cox | 70/268 |
| 3,970,339 | 7/1976 | Haselton et al. | 292/227 |
| 4,006,471 | 2/1977 | Pappas | 340/274 R |

FOREIGN PATENT DOCUMENTS

| | | |
|---|---|---|
| 1130325 | 5/1962 | Fed. Rep. of Germany . |
| 7403756 | 2/1974 | Fed. Rep. of Germany . |
| 304335 | 1/1955 | Switzerland . |

*Primary Examiner*—Richard E. Moore

*Attorney, Agent, or Firm*—Quaintance & Murphy

[57] ABSTRACT

An emergency exit door latch includes a pivoted bolt which pivots into registration with a keeper and is urged in the projected position by a spring biased plunger. The spring biased plunger is retained within a hydraulic cylinder. Hydraulic lines connect the portion of the hydraulic cylinder in front of the plunger to the portion behind the plunger through a throttling means. Upon pressing against the door, the swinging bolt urges the plunger rearwardly so as to force fluid in the rear portion of the hydraulic cylinder through the line and the throttling means to the front portion of the hydraulic cylinder thereby allowing the bolt to slowly retract as the fluid is throttled.

Preferably, a push bar is provided having a detent means thereon which locks the bolt in its projected position. Upon pressing the push bar, the bolt is released so that it can be slowly retracted as pressure is placed on the door.

Preferably, there is an emergency release system which allows rapid transfer of fluid from the rear of the piston to the front of the piston upon the occurrence of an emergency condition such as tripping of a fire alarm or smoke alarm. This emergency system allows the hydraulic fluid to bypass the throttling device which generally retards retraction of the bolt.

An alarm system is connected to the latch and sounds whenever the latch is operated so as to alert personnel within the building that someone is trying to open the emergency door without authorization.

37 Claims, 3 Drawing Figures

Fig. 2
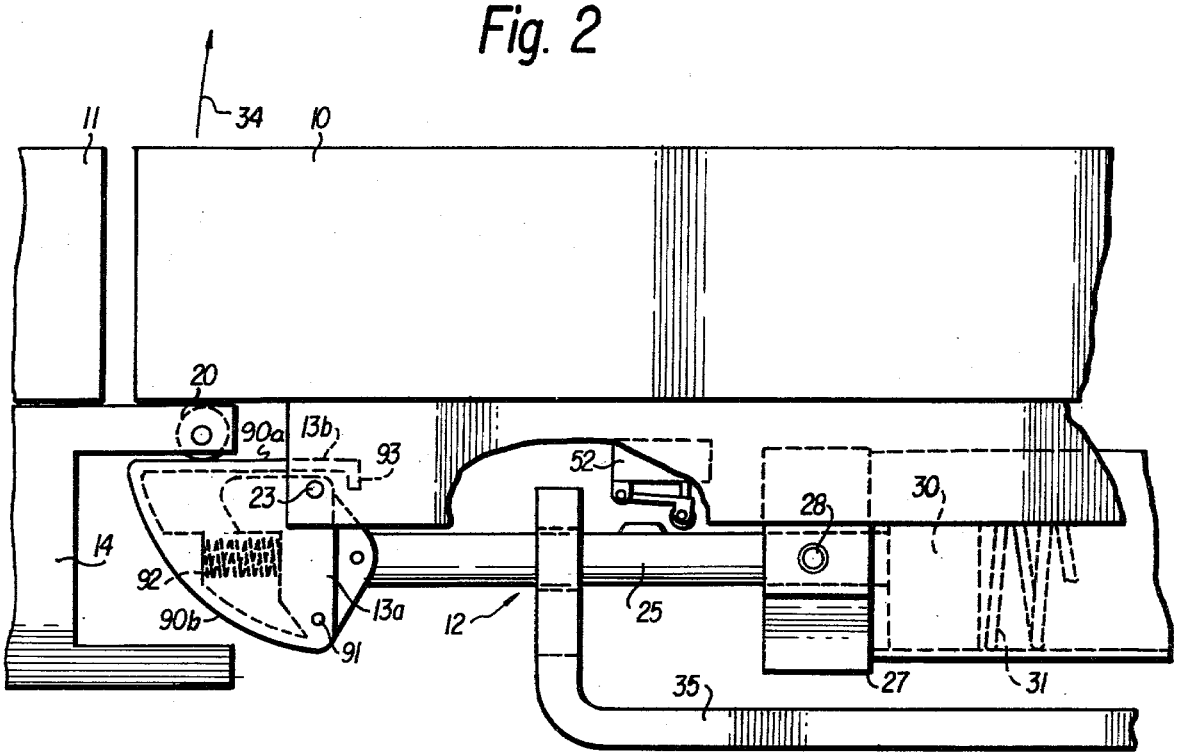
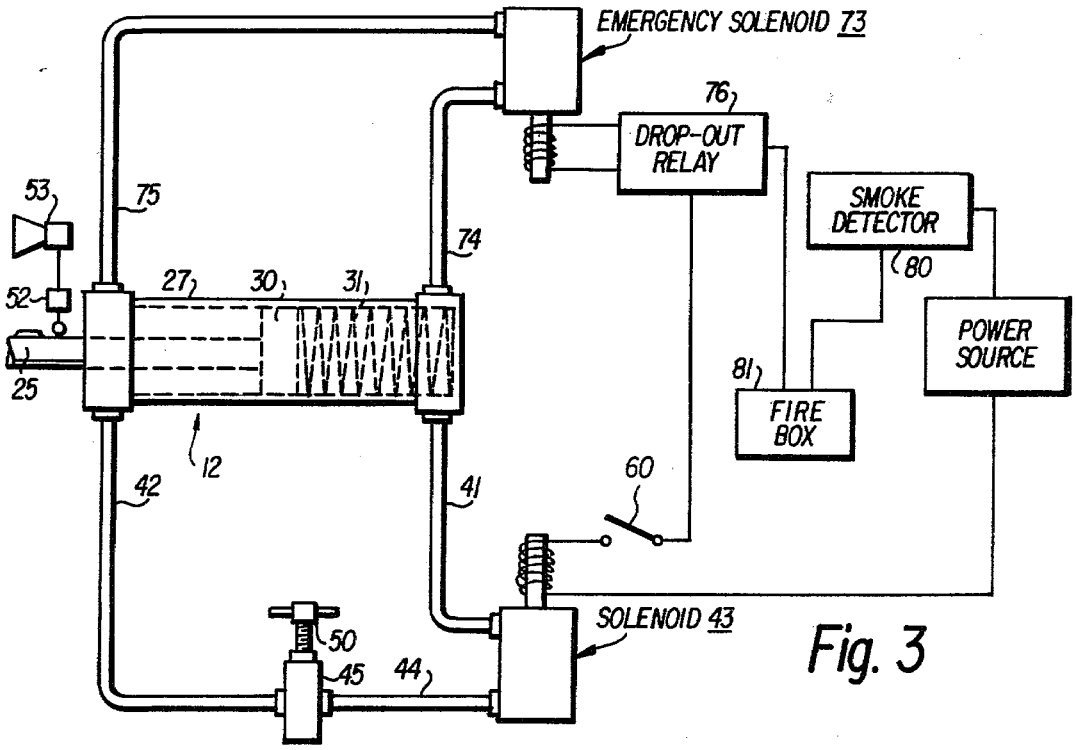
Fig. 3

POINT-OF-EGRESS CONTROL DEVICE FOR SECURING EXIT DOORS SAFELY

This application is a continuation-in-part of U.S. patent application Ser. No. 877,893, filed Feb. 15, 1978, and now abandoned.

BACKGROUND OF THE INVENTION

1. Field of the Invention

This invention relates to emergency exit door latches, and more particularly, to emergency exit door latches which open upon applying pressure to the emergency exit door or emergency exit door latch.

2. General Considerations and Prior Art

Public buildings such as schools, theaters, auditoriums, restaurants and the like must, by law, be equipped with latches that can be readily opened from within the buildings should there be a fire or other emergency situation. As a practical matter, it is necessary that the doors be locked against outside entry so that unauthorized persons cannot easily enter the building.

Currently, the emergency exit door latches used to accomplish the aforementioned objectives utilize push bars to permit occupants of the buildings to open doors by simply pushing the push bars. These push bars have a major drawback when used with emergency doors because any person inside of the building may simply push on the bars and open the doors immediately. Even if an alarm is sounded, there is not sufficient time to prevent a person pushing a bar from leaving the building and perhaps stealing contents from within the building. In schools this is a particularly acute problem because school authorities tend to put locks and chains on the emergency exit doors to prevent the doors from being opened. The locks and chains of course defeat the entire purpose of having emergency exit door latches which will allow the doors to open when pressure is exerted against the inside of the doors or against operators for the latches.

It is therefore readily seen that there is a need for a different kind of emergency exit door latch which will provide security while still allowing people within buildings to escape quickly in an emergency situation.

OBJECTS OF THE INVENTION

In view of the foregoing considerations it is an object of the instant invention to provide a new and improved latch for emergency exit doors.

It is a further object of the instant invention to provide a new and improved latch for emergency exit doors wherein the latch obviates the need felt by some people to chain or otherwise lock emergency exit doors.

It is a further object of the instant invention to provide a new and improved latch for emergency exit doors wherein the latch is readily integrated with both automatic and manual alarm systems so that emergency doors having the latch will be immediately openable upon detection of an unsafe condition.

It is a further object of the instant invention to provide a new and improved latch for emergency exit doors wherein the latch includes a system for operating the latch in a security mode and a system for operating the latch in an emergency mode.

It is a further object of the instant invention to provide a new and improved latch for emergency exit doors wherein the latch includes a system for a security locking mode in which the latch does not become unlatched immediately upon applying pressure to the door, but rather requires a time interval before opening, during which interval an alarm is sounded.

It is a further object of the instant invention to provide a latch for an emergency exit door wherein the latch is retarded in opening during a security mode and will open immediately during an emergency mode.

It is a further object of the instant invention to provide a new and improved emergency exit door latch which can be remotely monitored and controlled from a central location as well as from a plurality of other locations, including alarm locations.

SUMMARY OF THE INVENTION

With the foregoing objects and other objects in mind, the instant invention contemplates a securing system for an exit door which prevents the door from opening when in a first mode and allows the door to open when in a second mode. The system includes structure for retaining the securing means in the first mode which, when released, allows the securing means to shift to the second mode. The transition from the first mode to the second mode is delayed for a time interval, which time interval is initiated upon an attempt to open the door. Upon attempting to open the door, a signal occurs for indicating that an attempt to open the door has been made.

One embodiment of the instant invention contemplates a latch which is operated by application of force to a piston which controls the position of the latch so as to throttle a fluid thereby preventing instantaneous opening of the latch during application of the force.

The instant invention further contemplates a latch for an emergency exit door wherein pressure on the door causes the latch to pressurize a fluid which is throttled so as to retard retraction of the latch. Preferably, an alarm is sounded as the latch is urged towards its retracted position and pressurizes the fluid. If desired or necessary, the latch is equipped with a system providing an emergency operating mode wherein the fluid is not throttled thereby allowing the latch to open quickly.

BRIEF DESCRIPTION OF THE DRAWINGS

FIG. 2 is a schematic top view of the latch shown in FIG. 1 illustrating the operation of the latch; and FIG. 3 is a schematic circuit diagram showing the hydraulic and electrical system utilized to control the latch shown in FIGS. 1 and 2.

DETAILED DESCRIPTION

Figure 1:
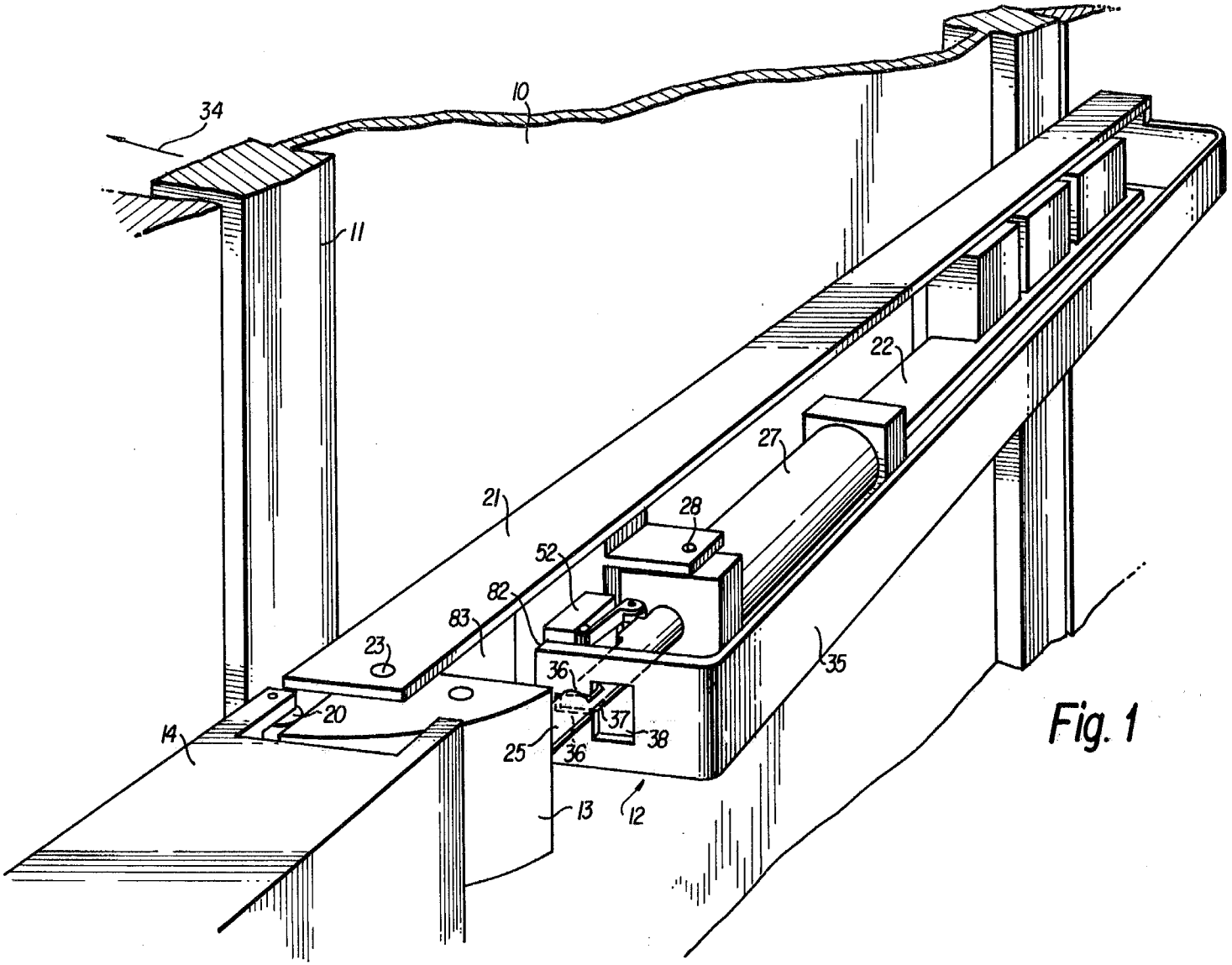
FIG. 1 is a perspective view of a latch according to the instant invention, mounted on an emergency door.

Referring now to FIG. 1, there is shown a door 10 mounted within a door jam 11. The door 10 is a swinging door and has a latch 12, according to the instant invention, mounted thereon. The latch 12 has a botl 13 which registers with a keeper 14 on the door jam. Preferably, the keeper 14 has a roller 20 mounted therein to reduce friction between the bolt 13 and keeper 14 thereby allowing smoother and easier operation of the latch. The bolt 13 and keeper 14 cooperate to provide a security means which prevents the door 10 from opening when in a first mode and allows the door to open when in a second mode.

As is seen in FIGS. 1 and 2, the bolt 13 is mounted between upper and lower latch frames 21 and 22 respectively on a pivot 23 so as to pivot, or swing, into engagement with the keeper 14. An operating rod 25 is connected pivotally to the bolt 13 by a pivot pin 26 and is received in a hydraulic cylinder 27. The hydraulic cylinder 27 is mounted by a pivot 28 so as to rotate slightly as the rod 25 reciprocates to thereby accommodate changes in the angular orientation of the rod 25. The operating rod 25 has a piston 30 on one end thereof within the hydraulic cylinder 27. A coil spring 31 bears against the piston 30 and urges the piston 30 to the left in FIG. 2 and to the left in FIG. 1 so as to rotate the bolt 13 to its projected position. The spring 31 is compressed as the bolt 13 is rotated in the counterclockwise direction in FIG. 2 upon pushing the door 10 in the direction of arrow 34. Upon releasing pressure on the door, spring 31 pushes the cylinder 30 to the left in FIG. 2 tending to project the bolt 13 and hold the door closed.

In order to operate the latch 12, one presses on push bar 35 which has a pair of dogging detents 36 that engage slots 37 in the operating rod 25 in order to retain the bolt projected and thereby retain the security means in the first mode. Upon pressing the push bar 35 the detents 36 are disengaged or related from the slots 37 so as to register the operating rod 25 with a relatively large hole 38 in the push rod. This undogs the latch bolt 13 by allowing the operating rod 25 to slide back into the hydraulic cylinder 27 so that the bolt 13 can retract allowing the security means to shift from the first mode to the second mode. It is therefore seen that the door 10 is positively locked by engagement between bolt 13 and the keeper 14 as long as detents 36 are seated within the slots 37. Consequently, it is not possible to open the door 10 from the outside under ordinary circumstances. In the illustrated embodiment, the push bar 35 is cantilevered at one end to the frame members 21 and 22 and the detents 36 are urged into engagement with the slots 37 due to the inherent resiliency of the push bar 35. Other arrangements can be used in which the push bar 35 is simply urged by auxiliary springs to the locked condition in which the detents are engaged.

Referring now to FIG. 3, there is shown a first system for operating the latch 12 in a security locking condition and a second system for operating the latch 12 in a emergency operating condition. The first system includes a hydraulic line 41 connected to one end of the cylinder 27 behind the piston 30 and another hydraulic line 42 connected to the opposite end of cylinder 27 in front of the piston 30. The line 41 communicates with a solenoid operated valve 43 which, when opened, allows fluid to flow through line 41 and past to line 44. The line 44 is connected to a needle valve 45 which in turn is connected to line 42. The needle valve 45 may be adjusted manually by a screw 50, or the like, and throttles fluid flowing from line 44 to line 42 so as to control the rate at which the fluid flows. The rate at which the fluid flows determines the rate at which the bolt 13 can retract because the bolt 13 is connected to the piston 30 via operating rod 25. When a force is placed on the door 10 tending the move the door 10 in the direction of arrow 34 in FIG. 2, the bolt 13 starts rotating in the counterclockwise direction about pivot pin 23 urging piston 30 against the bias of spring 31. If the solenoid control valve 43 is opened, hydraulic fluid will flow in line 41 through the solenoid valve and into line 44. The needle valve 45 slows or meters passage of the hydraulic fluid so that the piston 30 will move slowly into the cylinder 27 and the bolt 13 will pivot slowly about pivot 23. During the period that pressure is placed upon the door 10, a switch 52 operated by the operating rod 25 and schematically shown in FIGS. 1 and 3, will trip an alarm 53 alerting people within the building and perhaps security personnel that someone is trying to open the door. The alarm 53 may be located adjacent the door and an additional alarm (not shown) may be disposed at a remote monitoring station. Preferably, the needle valve 45 will be set to throttle the hydraulic fluid so that the bolt 13 will take somewhere between fifteen and thirty seconds to completely retract, during which time a security alarm system will both discourage the person from using the emergency door 10 and can alert security personnel.

When the building is not in use, a switch 60 is provided which applies a current to the solenoid valve 43 closing the valve so that fluid within the cylinder 27 cannot flow from the rear of the piston 30 to the front of the piston via lines 41, 44 and 42. During these times it is practically impossible to open the doors 10 by pushing on the push bar 35. Current must be supplied to the solenoid valve 43 in order to block operation of the latch, consequently, if the current in the building goes off or is interrupted, the solenoid valve 43 is opened, allowing the latch 13 to retract. By having the solenoid valve normally open, a power failure within the building will not cause emergency doors 10 to lock.

Referring now to the second system which allows the latch 12 to function in an emergency situation, an emergency solenoid 73 is connected to a line 74 which communicates with the hydraulic cylinder 27 behind the piston 30 and with a line 75 which is connected to the cylinder 27 in front of the piston 30. The emergency solenoid valve 73 is normally closed so as to block the flow of fluid through lines 74 and 75. Accordingly, fluid will flow through lines 41, 44 and 42, respectively, upon applying pressure to the door. Consequently, the lock normally functions in the security operating condition. Upon opening the emergency solenoid valve 73, fluid can transfer rapidly from behind the piston 30 to the front of the piston 30 because the fluid is not throttled as it is with the security locking system. Accordingly, when pressure is placed on the door 10, the fluid will flow rapidly, allowing the bolt 13 to very quickly and perhaps almost instantly retract.

The emergency solenoid 73 is operated by a drop out relay which in turn is connected to an emergency alarm system which may include a smoke detector 80 and/or a fire pull alarm box 81 connected in series with the drop-out relay. Upon operation of the smoke detector 80 or fire pull box 81, the drop-out relay will cause the emergency solenoid valve 73 to open immediately so that the door 10 will swing open as soon as pressure is applied thereto allowing immediate exit from the building.

The first and second systems are independent of one another and provide in essence a security locking loop and emergency release loop. The security locking switch 60 may be overridden even when closed so as to hydraulically lock the latch 12 if there is an emergency condition sensed by smoke detector 80 or registered by fire pull box 81. If the building is closed and the switch 60 is shut so that solenoid valve 43 is closed and there is a fire within the building, the bolt 13 still remains projected because the detents, 36 on bar 35 remain registered with slots 37 and bolt 25. The emergency doors 10 therefore remain closed when there is a fire in the building unless operated from the inside. This is advantageous because if the emergency doors 10 are open due to the occurrence of a fire, they will allow additional oxygen in to feed the fire.

By utilizing the aforedescribed arrangement it is possible to design the emergency operating loops and locking security loops so that the bolt 13 will retract upon a continuous application of fifteen pounds of pressure against the door. Preferably, the bar 35 will bottom against the door with the edge 82 of the bar in abutment with surface 83 of the lock so that the fifteen pounds of pressure will be transmitted directly to the door and to the point of engagement between the keeper 14 and bolt 13.

In order to allow the latch 12 to latch when the door 10 is moved from the open to the closed position, the bolt 13 has two parts 13*a* and 13*b*. Part 13*b* has a first cam surface 90*a* which engages keeper 20 to latch the door 10 shut and a second cam surface 90*b* thereon which engages keeper 20 when the door 10 is moved from an open to a closed position. The part 13*b* is pivoted by pin 91 to part 13*a*. A coil spring 92 extends between the parts 13*a* and 13*b*. When the door 10 is closed, second cam surface 90*b* engages the roller 20 of the keeper 14 and the part 13*b* is pivoted about pin 91 in the clockwise direction against the bias of spring 92 allowing the bolt 13 to clear the roller. Upon clearing the roller, the part 13*b* snaps to its projected position due to the bias of spring 92. A lip 93 on the part 13*b* engages the part 13*a* to prevent the part 13*b* from rotating too far back in the counterclockwise direction. When a person tries to open the door 10, the parts 13*a* and 13*b* rotate together in the counterclockwise direction about pivot 23, due to engagement of part 13*a* by lip 93, so as to move the operating rod 25 back into cylinder 27.

In essence the aforedescribed embodiment sets forth a system for latching a door 10 wherein securing means including a bolt 13 and keeper 14 prevents the door from opening when in a first mode and allows the door to open when in a second mode. The detents 36 provide an abutment for retaining the securing means in the first mode while the bar 35 provides a release for disengaging the abutment so that the detents no longer retain the securing means in the first mode thereby allowing the securing means to shift to the second mode. The throttle 45 delays transition of the securing means from the first mode to the second mode.

The latch 12 serves as a holding means which holds the door 10 closed even after the push bar 35 is pressed. The bolt 13 transmits force to the latch 12 to unlatch the latch when the force is applied to the door in a direction for opening the door.

The foregoing description and example is for illustrative purposes only. The invention is to be limited only by the following claims.

What is claimed is:

1. A latch for latching an emergency exit closure operable from inside of an enclosure and unlocked with respect to the inside of the enclosure comprising:

a bolt for latching the closure when the bolt is in a first position and for unlatching the closure when the bolt is in a second position;

means for prolonging over a time interval movement of the bolt from the first position to the second position to delay opening of the closure;

means for initiating running of the time interval upon attempting to open the closure from inside the enclosure, and means responsive to an attempt to open the door for signaling that an attempt to open the door has occurred.

2. A latch as recited in claim 1 wherein the delaying means includes:

means connected to the bolt for pressurizing a fluid upon movement of the bolt from the first to the second position;

means connected to the pressurizing means for throttling the fluid as the fluid is pressurized by movement of the bolt for retarding movement of the bolt from the first position to the second position.

3. A latch as recited in claim 2 further including means for urging the bolt to the first position.

4. A latch as recited in claim 1 further including means for urging the bolt to the first position.

5. A latch as recited in claim 1, 2, 3 or 4 further including:

means for bypassing the delaying means whereby the bolt will move from the first position to the second position quickly, allowing almost immediate opening of the closure.

6. A latch for an emergency exit door comprising:

a closure-operated bolt for latching the exit door;

means for mounting the bolt for movement between the first position in which the bolt latches the door and a second position in which the bolt does not latch the door;

means for normally urging the bolt to the first position;

means for prolonging for a time interval movement of the bolt from the first position to the second position upon applying an opening force to the door to delay opening of the door;

means for initiating running of the time interval upon an attempt to open the door; and means for sounding an alarm upon an attempt to open the door.

7. A latch as recited in claim 6 further including:

means for positively holding the bolt in the first position; and means for deactivating the positive holding means upon applying a force against the door in the direction that the door opens whereby the bolt moves from the first position to the second position.

8. A latch as recited in claim 7 wherein the means for urging the bolt to the first position is a spring.

9. A latch as recited in claim 6 wherein the means for urging the bolt to the projected position is a spring.

10. A latch as recited in claim 8 wherein the means for prolonging movement of the bolt from the first position to the second position includes:

means for pressurizing a fluid; and means for throttling the fluid while it is pressurized so as to slow down movement of the bolt from the first position to the second position.

11. A latch as recited in claim 10 further including:

means for allowing rapid movement of the fluid upon pressurizing the fluid; and means for selectively operating the means that allows rapid motion of the fluid.

12. A latch as recited in claim 11 further including normally open means for allowing throttling of the pressurized fluid, and means for closing the normally open means so that the pressurized fluid cannot be moved, thereby locking the bolt in the first position.

13. A latch for an emergency door comprising:

a latch bolt for moving from a projected position in which it locks the emergency door to a retracted position in which the emergency door is unlocked;

means for pivotally mounting the bolt with respect to the door;

a fluid cylinder having a piston therein with a piston rod connected to the bolt;

throttle means connected to the fluid cylinder for throttling fluid pressurized by the piston as the bolt moves from the projected position to the retracted position in order to retard movement of the bolt from the projecteed position to the retracted position;

positive dogging means for preventing the bolt from moving from the projected to the retracted position; and means for disengaging the positive dogging means to allow one bolt to move from the projected position to the retracted position.

14. A latch as recited in claim 13 further including:

emergency valve means for allowing rapid movement of the fluid when the bolt is urged from the projected position to the retracted position; and means for maintaining the normally open emergency valve closed to cause the fluid to flow through the throttling means.

15. A latch as recited in claim 14 further including:

emergency condition responsive means for activating the operating means for the emergency valve wherein the occurrence of an emergency condition will automatically open the emergency valve.

16. A latch as recited in claim 3 or 4 wherein the means for moving the bolt to the first position includes a spring.

17. A door latching system for an emergency exit door closing an enclosure wherein the latching system operates when the door is unlocked with respect to the inside of the enclosure comprising in combination with the emergency exit door:

means for latching the door in a closed condition;

means for unlatching the door from inside the enclosure upon pressing against the door to allow the door to move to an open position;

delay means for delaying for a time interval unlatching of the door after operating the unlatching means;

means for initiating running of the time interval upon attempting to open the door, and means for signaling that the door is unlatching while the unlatching is being delayed.

18. The door latching system of claim 17 further comprising:

means for indicating an emergency situation, and means connected to the indicating means and connected between the delay means and latching means for bypassing the delay means upon indication of an emergency situation.

19. The door latching system of claim 17 or 18 further including means for blocking the delay means to prevent unlatching of the latching means.

20. The door latching system of claims 17 or 18 further including:

means for selecting a length of time that unlatching of the door is delayed.

21. A securing system for an emergency exit door, comprising:

securing means for preventing the door from opening when said securing means is in a first mode and for allowing the door to open when said securing means is in a second mode;

means for retaining the securing means in the first mode;

means responsive to an attempt to open the door for releasing the retaining means to allow the securing means to shift to the second mode;

means for delaying for a time interval transition of the securing means from the first to the second mode;

means responsive to an attempt to open the door for initiating running of the time interval; and means responsive to an attempt to open the door for signaling that an attempt to open the door has occurred.

22. The door securing system of claim 21 wherein the securing means includes a latch bolt and the retaining means includes an abutment which engages the securing means to hold the securing means in the first mode.

23. The door securing system of claim 21 wherein the retaining means positively holds the securing means in the first mode.

24. The door securing system of claim 21, 22 or 23 wherein the delaying means includes means connected to the securing means for throttling a fluid as the securing means shifts from the first mode to the second mode.

25. The door securing system of claim 21, 22 or 23 further including spring means for biasing the securing means to the first mode and wherein the delaying means includes means connected to the securing means for throttling a fluid as the securing means shifts from the first mode to the second mode.

26. The door securing system of claim 21, 22 or 23 further including:

means for controlling the delaying means to select a length of time for transition from the first to the second mode.

27. The door securing system of claim 21, 22 or 23 further including:

means for selecting a length of time that the securing means is delayed in transition from the first to the second mode.

28. The door securing system of claim 21, 22 or 23 wherein the delaying means includes means for throttling a fluid as the securing means shifts from the first mode to the second mode and further including means for selecting a length of time that the securing means is delayed in transition from the first to the second mode.

29. In combination with an emergency exit door, apparatus comprising:

push bar means mounted on the door for initiating opening of the door upon pressing the push bar;

means for holding the door closed even after the push bar is pressed; said holding means including means for transmitting to the holding means forces applied to the door in a direction for opening the door;

releasing means connected to the transmitting means for releasing the holding means in response to force transmitted by the transmitting means from a secured mode, in which the door is held closed, to an unsecured mode, in which the door is not held closed, and delay means connected to the releasing means for delaying shifting of the holding means from the secured mode to the unsecured mode, whereby opening of the emergency exit is delayed.

30. The combination of claim 29 further including alarm means for indicating that an attempt to open the door has occurred.

31. The combination of claim 29 wherein the holding means is a closure operated latch bolt.

32. The combination of claim 30 further including means for indicating that an attempt to open the door has occurred.

33. The combination of claim 29, 30, 31 or 32 wherein the releasing means includes a piston connected to the holding means and a hydraulic cylinder receiving the piston for pressurizing a fluid and wherein the delay means includes a throttle means for throttling the pressurized fluid to delay movement of the fluid from a pressurized to an unpressurized state.

34. The latch of claim 7, 8, 9, 10, 11 or 12 wherein the latch includes:

a keeper on a door jamb adjacent to the door;

a first surface on the bolt means engageable with the keeper when the bolt means is in the first position for holding the door closed when the latch is latched;

a second surface on the bolt means engageable with said keeper for camming the bolt means to the second position upon closing the door, and means for moving the bolt means from the first position to an unlatched condition upon engagement between the keeper and the second surface on the bolt means whereby the door is shut and relatched without activating the delay means.

35. The latch of claim 7, 8, 9, 10, 11 or 12 wherein the latch includes:

a keeper on a door jamb adjacent to the door;

a first surface on the bolt means engageable with the Keeper when the bolt means is in the first position for holding the door closed when the latch is latched;

a second surface on the bolt means engageable with said keeper for camming the bolt means to the second position upon closing the door, means for moving the bolt means from the first position to an unlatched condition upon engagement between the keeper and the second surface on the bolt means whereby the door is shut and relatched without activating the delay means, and wherein the means for deactivating the positive holding means includes:

a panic bar moveably mounted on the door for releasing the positive holding means when pressed, and stop means disposed between the panic bar and door for transmitting force applied to the panic bar directly through to the door after moving the panic bar to release the positive holding means.

36. A securing system for an emergency exit door, comprising:

securing means for preventing the door from opening when said securing means is in a first mode and for allowing the door to open when said securing means is in a second mode;

means for retaining the securing means in the first mode;

means responsive to an attempt to open the door for releasing the retaining means to allow the securing means to shift to the second mode;

means for delaying for a time interval transition of the securing means from the first to the second mode;

means responsive to an attempt to open the door for initiating running of the time interval;

means for signaling that an attempt has been made to open the door;

means for detecting the occurrence of an emergency condition, and means connected between the detecting means and the retaining means for bypassing the delaying means and allowing the securing means to shift to the second mode upon the detection of an emergency condition.

37. In combination with an emergency exit door, apparatus comprising:

push bar means mounted on the door for initiating opening of the door upon pressing the push bar;

means for holding the door closed even after the push bar is pressed; said holding means including means for transmitting to the holding means forces applied to the door in a direction for opening the door;

releasing means connected to the transmitting means for releasing the holding means in response to force transmitted by the transmitting means from a secured mode, in which the door is held closed, to an unsecured mode, in which the door is not held closed;

delay means connected to the releasing means for delaying shifting of the holding means from the secured mode to the unsecured mode, whereby opening of the emergency exit is delayed;

means for detecting the occurrence of an emergency condition, and means connected between the detecting means and to the means for holding the door closed for bypassing the delay means and allowing the means for holding the door closed to shift from the secured mode to the unsecured mode upon the detection of an emergency condition.

* * * * *